United States Patent [19]

Beck et al.

[11] Patent Number: 4,740,156

[45] Date of Patent: Apr. 26, 1988

[54] IGNITION SPARK EMITTER AND FUEL OPERATED HEATING DEVICE EQUIPPED THEREWITH

[75] Inventors: Wolfgang Beck; Norbert Hochmuth, both of Munich; Ernst Mosig, Iffeldorf, all of Fed. Rep. of Germany

[73] Assignee: Webasto-Werk W. Baier GmbH & Co., Gauting, Fed. Rep. of Germany

[21] Appl. No.: 917,221

[22] Filed: Oct. 9, 1986

[30] Foreign Application Priority Data

Oct. 10, 1986 [DE] Fed. Rep. of Germany ..... 35361980

[51] Int. Cl.[4] ..... F23Q 3/00

[52] U.S. Cl. ..... 431/265; 361/247

[58] Field of Search ..... 431/265, 264; 361/247

[56] References Cited

U.S. PATENT DOCUMENTS 2,045,178 6/1936 De Lancey ..... 431/265

*Primary Examiner*—Carroll B. Dority, Jr.

*Attorney, Agent, or Firm*—Sixbey, Friedman & Leedom

[57] ABSTRACT

An ignition spark emitter for a fuel operated heating device has two electrodes which are addressed by a transformer and deliver ignition sparks. The ignition electrodes are secured at a housing of the ignition spark emitter which also contains the transformer and the power supply unit of the ignition spark emitter. A plug connector, which preferably, is disposed in the form of a plug-in unit is provided at the housing of the ignition spark emitter, and not only establishes the electrical connection of the ignition spark emitter, but also serves for its mounting, preferably, in proximity of the nozzle assembly of the burner. One of the ignition electrodes, in connection with a ground circuit, can be utilized for ionization flame monitoring via the combustion tube of the heating device, whereby the ionization flame monitor appropriatelylame monitoring via the combustion tube of the heating device, whereby the ionization flame monitor appropriately is operated in a time multiplex manner. An evaluation device, whose output signal is transmitted for ionization flame monitoring via the plug connector for further processing, is also disposed in the emitter housing.

20 Claims, 3 Drawing Sheets

IGNITION SPARK EMITTER AND FUEL OPERATED HEATING DEVICE EQUIPPED THEREWITH

BACKGROUND AND SUMMARY OF THE INVENTION

The invention relates to an ignition spark emitter for fuel operated heating devices.

Dependent upon the type of burner installed, it has been customary to use an ignition spark emitter, in fuel operated heating devices, which has two ignition electrodes whose free ends are positioned relative to the burner nozzle outlet in such a way that an emission of ignition sparks, controlled by a transformer, will ignite a mixture of fuel and air produced in the area of the nozzle outlet. To this end, the ignition electrodes are connected via electrical lines to a power supply unit that is remote from the burner nozzle assembly and which also contains a transformer for the controlled production of ignition sparks. In such a situation, the ignition electrodes must be attached and correspondingly aligned, and the attachment as well as the alignment of the ignition electrodes is time-consuming and costly. Cable connection of the ignition electrodes with the electrical power unit not only results in transmission losses, but also may entail disturbances in the high frequency range.

It is the objective of the invention to develop an ignition spark emitter for fuel operated heating devices which may be contained in the heating device in a space-saving manner, while also providing a reliable operation without transmission losses or high frequency disturbances.

In accordance with a preferred embodiment of the invention, the ignition spark emitter for fuel operated heating devices is characterized in that the ignition electrodes can be secured to a housing which contains the transformer and the power supply units, and further in that a plug connector is provided for the electrical connection of the ignition spark emitter housing, which connector serves as a mount for the entire ignition spark emitter.

In the ignition spark emitter in accordance with the invention, by securement of the ignition electrodes at the housing, alignment of the electrode spacing can be eliminated, since the housing simultaneously serves as the mounting for the ignition electrodes. Due to the fact that the housing also contains the transformer and a power supply unit, line connections, like ignition cables, which previously have been necessary, can be eliminated, so that a loss-free energy supply is achieved, in which high frequency disturbances are suppressed. A substantial simplification in mounting of the inventive ignition spark emitter is further realized in that the housing not only serves as a mount for the ignition electrodes, but has a plug connection for the electrical connection, preferably a multipolar plug-in unit by which the ignition spark emitter housing, together with the ignition electrodes, is secured at a predetermined point in the heating device. In order to prevent the disengagement of the ignition spark emitter housing plug connection, the ignition spark emitter housing can also be secured, for instance, by means of screws, after the plug connection has been established.

The plug connection of the housing of the ignition spark emitter contains a minimum of one control input, via which it can be addressed, such that it can be switched on and off, and its pulse frequency as well as its input duration can be controlled. Preferably, a control unit of the heating device determines the control input volumes, without, however, a requiring a relay. As a consequence, an energy free control is realized.

In accordance with an advantageous further embodiment, the ignition spark emitter is designed so that an ignition electrode, in connection with a ground circuit, is utilized for ionization flame monitoring. Accordingly, two functions are integrated into the ignition spark emitter, namely that of the actual ignition device and that of flame monitoring. Therefore, separate components for flame monitoring can be eliminated, whereby the assembly of such heating device is simplified. The ground circuit can be established by having the ignition spark sender housing conductively connected with a combustion tube of the heating device, preferably by way of a connecting flange.

Appropriately, in this dual function embodiment, an analyzer for the ionization flame monitoring device is provided, whose output is connected with a pole of the plug connector so that, via the plug connection, dependent upon the determined result of the analyzer, a signal is retransmitted to the control device. If, subsequent to the ignition process, a flame has formed in the combustion chamber of the heating device, a signal is sent to the control unit, via the output of the analyzer, that indicates this flame. If conversely, no flame has formed after the ignition process, another signal will cause, via the control unit, the ignition process to be repeated.

In order to obtain a construction of the ignition spark emitter which is space-saving and compact, the transformer of the emitter contained in the ignition spark housing is switched in a time multiplex process, so that it can be utilized for ignition spark delivery as well as ionization flame monitoring.

If, furthermore, the ignition electrodes are detachably secured to the housing, for instance, by provision of a plug connector, the electrodes can be easily coordinated to the size of the heating device, and the heating capacity delivered by the heating device. Thus, without altering the basic structural form of the ignition spark emitter, the ignition electrodes can be quickly and easily exchanged, facilitating also a more economical inventory of the components, since a number of different electrodes may be attached to the same basic emitter unit.

In accordance with the invention, the ignition spark emitter housing, with the ignition electrodes and the elements contained in the housing, is preferably arranged as close as possible to the burner nozzle assembly. Such an arrangement is realized due to the fact that the ignition spark emitter housing may be made as small and compact as possible.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
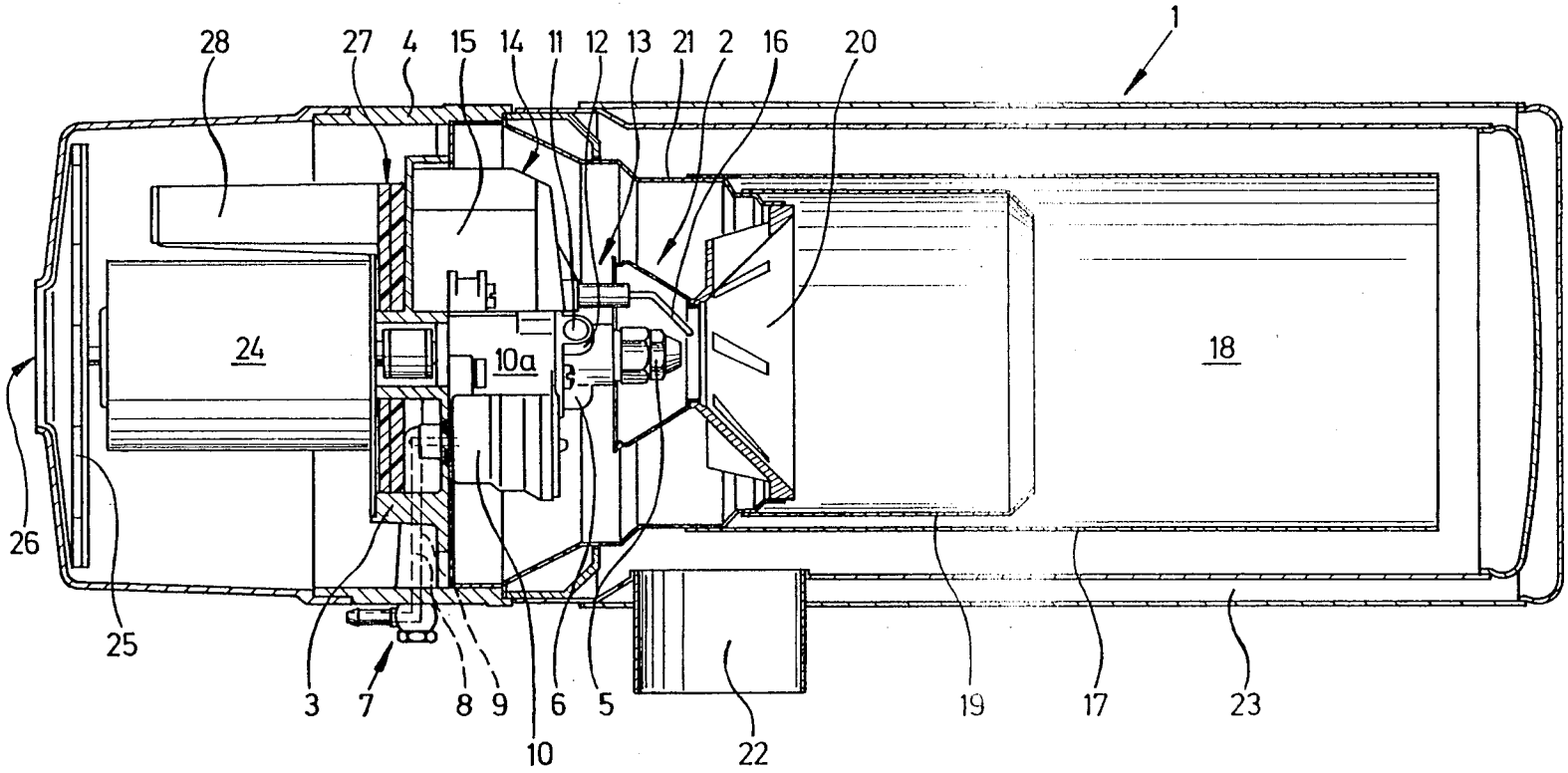
FIG. 1 is a schematic sectional view of a heating device with an ignition spark emitter, in accordance with the invention.

FIG. 1 schematically depicts a heating device, designated in its entirety with reference numeral 1, having an atomization burner, designated in its entirety with numeral 2. The atomization burner 2 is attached to a flange 3, which is disposed on a housing part 4. As depicted, burner 2 has an atomization nozzle 5 supported by a burner nozzle assembly 6. A fuel supply connection is formed in flange 3 of housing part 4, which has a feed line 8 and return line 9, depicted in broken lines, to provide the fuel supply to nozzle 5. Feed line 8 terminates in a filter 10, which is upstream of fuel pump 10*a*, as schematically depicted in FIG. 1. By way of a solenoid valve, not depicted in FIG. 1, the delivering of fuel to nozzle 5 may be regulated. In the example depicted, atomization nozzle 5, along with burner nozzle assembly 6, the fuel pump 10*a*, the filter 10 and the solenoid valve, form a component which can be attached to flange 3 as a unit. FIG. 1 also shows a through bore 11 which is disposed in a shoulder 12 formed on burner nozzle assembly 6 and which serves to receive a preheating device, not depicted, preferably, a self-contained heating element.

Furthermore, atomization burner 2 has an ignition device, designated 13 in its entirety, which is formed by an ignition spark emitter 14 having a housing 15. Preferably, two ignition electrodes 16, only one of which is shown in FIG. 1, are mounted at housing 15 by way of a plug connection.

The burner 2 extends into a combustion chamber 18 formed by combustion tube 17. An insert 19 is arranged in the combustion chamber for the purpose of flame support. In an axial direction relative to the nozzle 5, and at a distance therefrom, there is a vorticization element 20 that is supported by a mounting element 21 in the housing of heating device 1, which element 21 also carries insert 19 and combustion tube 17.

The combustion gases pass from combustion chamber 18 to an exhaust gas outlet 22, after having been deflected at that end of combustion tube 17 opposite atomization burner 2. Combustion tube 17 is surrounded by a double wall heat exchanger arrangement in whose annular space 23 a heat exchange medium, e.g., water, is circulated from an inlet to an outlet, not depicted. The heat exchange medium is heated in annular space 23 by the combustion gases as they flow countercurrent to the path of the heat exchange medium, when the heating device 1 is operated.

As can be further seen from FIG. 1, a combustion motor 24 is provided at flange 3, on the opposite side thereof from nozzle 5. Motor 24 simultaneously drives combustion air blower 25 and fuel pump 10*a*. Combustion air flows into inlet 26 and, aided by the combustion air blower 25, is conveyed along a path through the interior of the housing of the heater to a mixture treatment zone in the outlet area of burner nozzle 5.

A connecting device, designated in its entirety with reference numeral 27, serves to simultaneously supply power to the various components of the heating device, like combustion motor 24, ignition spark emitter 14, the flame monitoring device, burner nozzle assembly, preheating device, and the like. Connecting device 27 is provided between combustion motor 24 and the rear side of flange 3 (the side facing away from the nozzle 5). Cooperating with this connecting device 27, is a control unit 28, which preferably is joined with the device 27 by way of a plug connector.

Figure 2:
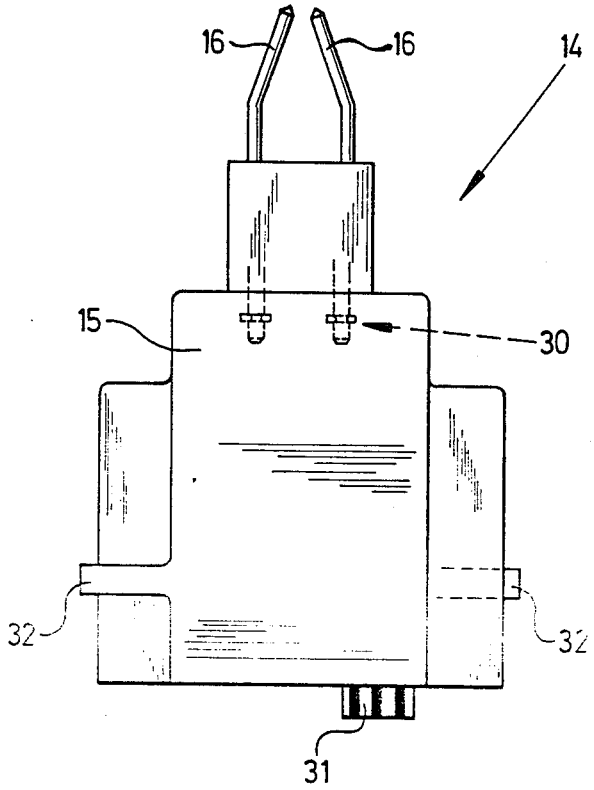
FIG. 2 shows the ignition spark emitter of the FIG. 1 heating device, by itself.

FIG. 2 shows the ignition spark emitter, itself, without the heating device 1 of FIG. 1. Two ignition electrodes 16 are secured at housing 15 of ignition spark emitter 14. As indicated by broken lines in FIG. 2, ignition electrodes 16 are detachably inserted into housing 15 by means of a plug connector 30. A multi-polar plug-in unit 31 is provided at the side of housing 15 which is opposite ignition electrodes 16 and serves to establish a plug-in connection with connecting device 27 (see FIG. 1). This plug-in unit 31 projects from the body of housing 15 of ignition spark emitter 14 and can be plugged into a corresponding member of connecting device 27 for mounting of ignition spark emitter 14. The housing has flange-like extensions 32 which can have bores for passage of screws, not depicted, used to secure the ignition spark emitter housing 15 to flange 3 after establishing the plug-in connection thereof.

It is to be understood that ignition electrodes 16, alternatively, can be fixedly attached at housing 15.

As can be further seen from FIG. 2 in light of FIG. 1 of the drawing, the shape and size of the housing 15 of the ignition spark emitter 14 are selected so that the housing can be installed in the immediate proximity of the atomization burner 2.

Figure 3:
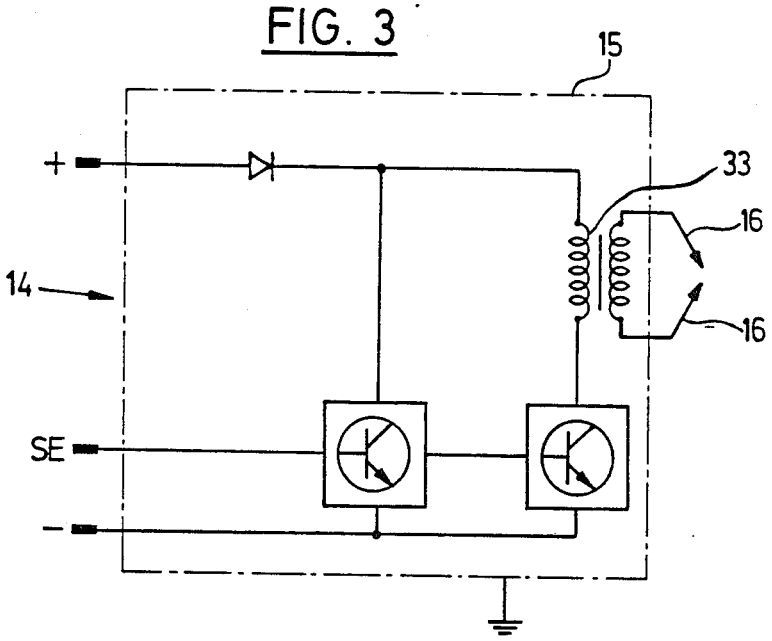
FIG. 3 is a circuit diagram for a circuit contained in the ignition spark emitter for addressing of the ignition electrodes.

FIG. 3 shows an embodiment of a circuit for addressing the electrodes 16 that are contained in housing 15 of ignition spark emitter 14. The inputs depicted in FIG. 3 to the left, are provided in plug-in unit 31, and comprise positive and negative poles as well as a control input SE which, for instance, is connected with control unit 28 via connecting device 27 (see FIG. 1). Via resistors, diodes and transistors, which are depicted in the circuitry according to Figure 3, the ignition transformer 33, to which the ignition electrodes are connected, in cooperation with the control input SE, as well as control unit 28, is addressed so that ignition spark emitter 14 is switched on and off via control input SE, and impulse frequency and duration of the switched-on condition are controlled. The input volumes, appropriately, are predetermined and preset by control unit 28 and are sent correspondingly to control input SE of the ingition spark emitter 14. Thus, no relay is required for the addressing of the ignition spark emitter 14, resulting in a control function which produces no power losses. The ignition sparks delivered by ignition electrodes 16 cause the combustible mixture produced in the area of atomization nozzle 5 to be ignited for the operation of heating device 1. In addition to transformer 33, housing 15 also contains the entire circuitry serving as a power supply for ignition spark emitter 14.

Figure 4:
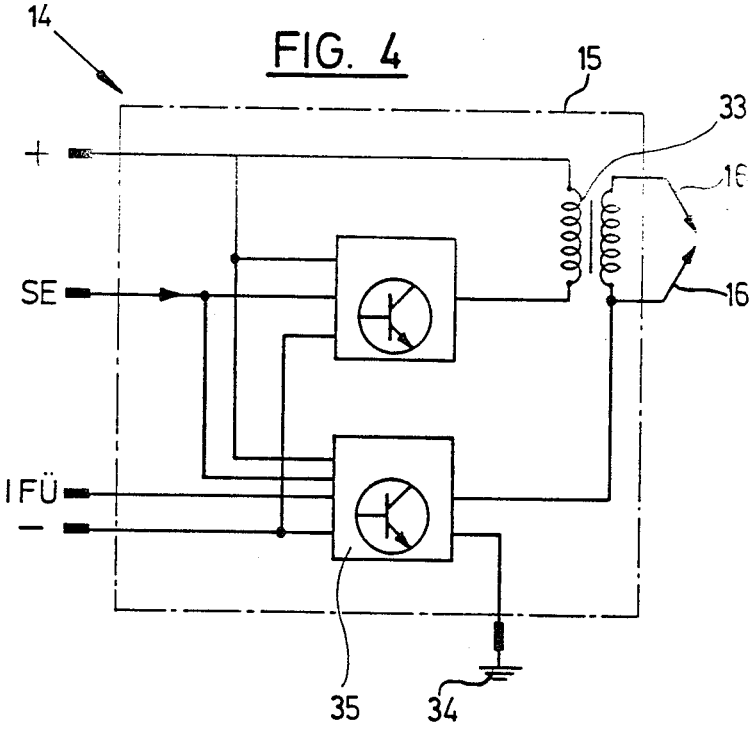
FIG. 4 is a circuit diagram for a circuit contained in the ignition spark emitter in accordance with a modified embodiment of the invention, in which the ignition spark emitter is also utilized for flame monitoring.

FIG. 4 shows a modified circuit embodiment. This circuitry is also totally contained in housing 15 of ignition spark emitter 14. Parts that are identical or similar to parts shown in FIG. 3 have identical reference numerals. The circuitry, in accordance with FIG. 4, is designed such that, in a time multiplex process, one of the ignition electrodes 16, together with ground circuit 34, serves to provide ionization flame monitoring. Such a ground circuit 34 can be established by a conductive connection with combustion tube 17 via one of the flange-like connecting extensions 32 of ignition spark emitter 14, flange 3 and mounting element 21.

Accordingly, ignition spark emitter 14 performs a dual function and the circuits required therefor are all contained in ignition spark emitter housing 15. The resultant short conduction paths not only facilitate a no-loss energy supply, but also permit a suppression of high frequency disturbances which, otherwise, would be transmitted via the line connections. Such ionization flame monitoring replaces the additional flame monitoring devices which were customarily required in the past.

Moreover, circuitry in accordance with FIG. 4 comprises an evaluation device 35 for ionization flame monitoring, which device, at its outlet IFU, emitts a signal based upon the evaluation result. This evaluation result is transmitted to control unit 28, in FIG. 1, via plug-in unit 31. Depending upon this signal, the ignition spark emitter is switched off, and if appropriate, the ignition process is repeated in accordance with the presetting of control unit 28.

In the FIG. 4 embodiment, transformer 33 is utilized in a time multiplex process, either for ignition, via ignition electrodes 16, or for the ionization flame monitoring, via one of the ignition electrodes 16. In other respects, the circuit details of the circuit diagrams according to FIGS. 3 and 4 are self-explanatory.

As described above, ignition spark emitter 14 does not require supply lines and ignition cables, due to the fact that the power supply unit and the transformer 33 also are contained in housing 15 of ignition spark emitter 14. The resultant energy supply is economical in consumption of energy and, moreover, high frequency disturbances can be suppressed, which otherwise might be transmitted into the entire power supply system and lead to a malfunction in the operation of the heating device 1. Moreover, adjustment of the spacing of the ignition electrodes 16 is eliminated due to the fact that housing 15 of ignition spark emitter 14 simultaneously serves for mounting the ignition electrodes 16. The compact design of the ignition spark emitter 14 permits the entire device to be disposed in a space saving arrangement within the housing of the heater at a location in immediate proximity of burner nozzle assembly 6.

It is to be understood that instead of plug-in unit 31, as the plug connector, multi-polar connections or similar devices can be provided which fulfill the same purpose in accordance with the invention. If appropriate or necessary, one or several poles or inputs of the ignition spark emitter 14 can be joined to two or more plug-in units 31; or pole connections can be combined with plug-in units.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Ignition spark emitter for a fuel operated heating device of the type having a pair of ignition electrodes which deliver ignition sparks when addressed by a transformer, wherein the ignition electrodes are securable at a housing which contains the transformer and a power supply unit, and wherein a plug connector is provided at the ignition spark emitter housing as an electrical connection by way of which the ignition spark emitter, as a whole, can be mounted in a heater, wherein one of said ignition electrodes together with a ground circuit forms an ionization flame monitoring device.

2. Ignition spark emitter according to claim 1, wherein the plug connector comprises a control input, via which the ignition spark emitter can be switched on and off, and its impulse frequency and input duration controlled.

3. Ignition spark emitter according to claim 2, wherein the ionization flame monitoring device also comprises an evaluation device which is contained in the ignition spark emitter housing.

4. Ignition spark emitter in accordance with claim 3, wherein an output of the evaluation device is connected with the plug connector and transmits a flame signal based upon an evaluation conducted by the evaluation device.

5. Ignition spark sender according to claim 4, having multiplexer means for operating the transformer of the ignition spark emitter in a time multiplex manner for ignition spark delivery and ionization flame monitoring.

6. Ignition spark emitter according to claim 1, wherein the ionization flame monitoring device also comprises an evaluation device which is contained in the ignition spark emitter housing.

7. Ignition spark emitter in accordance with claim 6, wherein an output of the evaluation device is connected with the plug connector and transmits a flame signal based upon an evaluation conducted by the evaluation device.

8. Ignition spark sender according to claim 7, having multiplexer means for operating the transformer of the ignition spark emitter in a time multiplex manner for ignition spark delivery and ionization flame monitoring.

9. Ignition spark sender according to claim 1, having multiplexer means for operating the transformer of the ignition spark emitter in a time multiplex manner for ignition spark delivery and ionization flame monitoring.

10. Ignition spark emitter according to claim 1, wherein the ignition electrodes are insertably mounted at the housing.

11. Ignition spark emitter according to claim 1, wherein the ignition spark emitter housing, together with the ignition electrodes are mountable in the heater in immediate proximity of a burner nozzle assembly.

12. Ignition spark emitter according to claim 1, wherein the plug connector has a multi-polar plug-in unit.

13. In a fuel operated heater of the type having a housing, a burner with an atomization burner nozzle assembly disposed within the housing of the heater, combustion air blower means for delivering a supply of combustion air into and through said housing of the heater to an outlet area of the burner nozzle assembly, and an ignition spark emitter with a pair of ignition electrodes which deliver sparks when addressed by a transformer, wherein the ignition electrodes are securable at a housing of the ignition spark emitter which contains the transformer and a power supply unit, and wherein a plug connector is provided at the ignition spark emitter housing as an electrical connection by way of which the ignition spark emitter, as a whole, is mounted in said housing of the heater.

14. Fuel operated heater according to claim 13, wherein the ignition spark emitter housing, together with the ignition electrodes, is mounted within the housing of the heater in immediate proximity of the burner nozzle assembly.

15. In a fuel operated heater of the type having a burner with an atomization burner nozzle assembly and an ignition spark emitter with a pair of ignition electrodes which deliver sparks when addressed by a transformer, wherein the ignition electrodes are securable at a housing which contains the transformer and a power supply unit, and wherein a plug connector is provided at the ignition spark emitter housing as an electrical connection by way of which the ignition spark emitter, as a whole, is mounted in the heater, wherein the ignition spark emitter housing, together with the ignition electrodes, is mounted within a housing of the heater in immediate proximity of the burner nozzle assembly, wherein the burner nozzle assembly and the ignition spark emitter are carried by a flange member of the heater housing.

16. Fuel operated heater according to claim 15, wherein said plug connector electrically connects with a control unit via a connecting device, said control unit and connecting device also being carried by the flange member of the heater housing.

17. In a fuel operated heater of the type having a burner with an atomization burner nozzle assembly and an ignition spark emitter with a pair of ignition electrodes which deliver sparks when addressed by a transformer, wherein the ignition electrodes are securable at a housing which contains the transformer and a power supply unit, and wherein a plug connector is provided at the ignition spark emitter housing as an electrical connection by way of which the ignition spark emitter, as a whole, is mounted in the heater, wherein said ignition spark emitter also serves as an ionization flame monitoring device comprised of one of said electrodes, a ground circuit, an evaluation device contained in the ignition spark emitter housing, multiplexer means for operating said transformer in a time multiplex manner, and said plug connector.

18. Fuel operated heater according to claim 17, wherein said ground circuit includes a combustion tube of the heater.

19. Fuel operated heater according to claim 13, wherein the burner nozzle assembly and the ignition spark emitter are carried by a flange member of the heater housing.

20. Fuel operated heater according to claim 19, wherein said plug connector electrically connects with a control unit via a connecting device, said control unit and connecting device also being carried by the flange member of the heater housing.

* * * * *